United States Patent [19]

Gruenbaum et al.

[11] Patent Number: 4,898,797

[45] Date of Patent: Feb. 6, 1990

[54] MULTIPLE XEROPRINTED COPIES FROM A SINGLE EXPOSURE USING PHOTOSENSITIVE FILM BUFFER ELEMENT

[75] Inventors: William T. Gruenbaum; William Mey, both of Rochester; Kelly S. Robinson, Fairport, all of N.Y.

[73] Assignee: Eastman Kodak Company, Rochester, N.Y.

[21] Appl. No.: 220,867

[22] Filed: Jul. 18, 1988

[51] Int. Cl.[4] ..... G03G 13/24

[52] U.S. Cl. ..... 430/51; 430/55

[58] Field of Search ..... 430/51, 55

[56] References Cited

U.S. PATENT DOCUMENTS

| | | | |
|---|---|---|---|
| 4,047,945 | 9/1977 | Pfister et al. . | |
| 4,392,737 | 7/1983 | Nishikawa | 355/3 R |
| 4,407,918 | 10/1983 | Sato | 430/54 |
| 4,413,044 | 11/1983 | Nishikawa | 430/53 |
| 4,420,547 | 12/1983 | Nishikawa | 430/57 |
| 4,433,038 | 2/1984 | Nishikawa | 430/55 |
| 4,440,843 | 4/1984 | Nishikawa | 430/55 |
| 4,440,844 | 4/1984 | Nishikawa | 430/55 |
| 4,442,191 | 4/1984 | Nishikawa | 430/55 |

*Primary Examiner*—Paul R. Michl
*Assistant Examiner*—Jeffrey A. Lindeman
*Attorney, Agent, or Firm*—David F. Janci

[57] ABSTRACT

Disclosed is a method of improving the sharpness of multiple copies made from a single imagewise exposure using an electrostatographic film buffer element having an insulating layer in between a conductive layer and a photoconductive layer, where the element is simultaneously charged and imagewise exposed and then uniformly exposed with light to bury the charges. The improvement consists of performing the uniform exposure with light that is absorbed by the photoconductive layer and does not penetrate through the photoconductive layer to the insulating layer. Also disclosed is apparatus useful for making multiple copies which comprises an electrostatographic film buffer element which comprises, (A) in order, a conductive layer, an insulating layer, and a photoconductive layer, (B) means for simultaneously charging the imagewise exposing the element, and (C) means for uniformly exposing the element with light that is absorbed by the photoconductive layer and does not penetrate through the photoconductive layer to the insulating layer. Also disclosed is a method of making multiple electrostatographic copies comprising simultaneously charging and imagewise exposing an electrostatographic film buffer element which comprises, in order, a conductive layer, an insulating layer, and a photoconductive layer, uniformly exposing the element with light that is absorbed by the photoconductive layer and does not penetrate through the photoconductive layer to the insulating layer, thereby forming a latent electrostatic image on the insulating layer, developing the latent electrostatic image and transferring the developed image to a receiver, and repeating the previous step without additional imagewise exposures of the element.

8 Claims, 5 Drawing Sheets

MULTIPLE XEROPRINTED COPIES FROM A SINGLE EXPOSURE USING PHOTOSENSITIVE FILM BUFFER ELEMENT

TECHNICAL FIELD

The invention relates to a process and apparatus for xeroprinting multiple copies from a single imagewise exposure. More particularly, the invention concerns the use of a xeroprinting film buffer element having an insulating layer disposed between a conductive layer and a photoconductive layer where a uniform exposure of the element after simultaneously charging and imagewise exposing the element drives the charges to the insulating layer.

BACKGROUND ART

In a conventional electrostatographic printing process a photoconductive element is charged in the dark, typically with a corona, and is then imagewise exposed. Exposure to the light generates positive-negative charge pairs which discharge those areas of the photoconductor that were exposed to the light, thereby forming an electrostatic image on the photoconductor. The image is then developed with a toner and the developed image can be transferred to a receiver, such as paper, to make a copy. After each copy, the photoconductor must be cleaned, recharged, and exposed to the light image again.

While that procedure produces good copies, it can require a great deal of time under certain circumstances. For example, if the image on the photoconductor is written by a laser and is a high resolution image having many millions of pixels, a great deal of time will be required for the image-wise exposure, and, if this exposure must be repeated for each copy, making multiple copies can require an inordinate amount of time. This is especially true if color copies are to be produced because three or four imagewise exposures must be made for each color copy.

In order to speed up the process of making multiple copies, it would be desirable to eliminate the necessity of recharging and imagewise exposing the photoconductor after each copy is made. However, if a conventional photoconductive element is used and a single imagewise exposure is used to make several copies, the quality of the copies quickly deteriorates because the developing and transfer steps disrupt the distribution of charges on the photoconductor.

In order to overcome this problem special photoconductive elements have been constructed that have an insulating layer in between a photoconductive layer and a conductive layer. (See U.S. Pat. No. 4,407,918.) Using this special element, the photoconductor is charged at the same time that it is imagewise exposed. This results in the charges on the exposed areas being buried at the insulating layer while the charges on the unexposed area remain on the surface of the photoconductor. However, because the element is charged at the same time as the imagewise exposure is made, the buried charges are proportionally greater than the charges on the surface of photoconductor, with the result that the overall surface potential of the photoconductor is uniform. The photoconductor is then uniformly exposed which drives the charges on the surface down to the insulating layer. But, since there were fewer charges on the surface, the electrostatic image is preserved at the insulating layer, and because the electrostatic image is buried at the insulating layer, it is preserved for a long time and is not significantly disrupted by the developing or transfer steps. Multiple copies can therefore be made without a significant loss in quality from one copy to the next.

However, it was found that these copies were unsharp at the edges of the images and, while the quality of the copies did not deteriorate, the quality was poorer than the quality obtained using a conventional photoconductive element because the edges of the image were blurred.

DISCLOSURE OF INVENTION

While we do not wish to be bound by any theories, we believe that the blurredness of the edges of images in multiple copies made using a photoconductive element having an insulating layer between a conductive layer and a photoconductive layer is due to the generation of charge pairs at or near the insulating layer by the light used in the uniform exposure of the photoconductive element. We believe that the charges in these charged pairs move laterally, which blurrs the edges.

We have discovered that if the light used during the uniform exposure is prevented from reaching the insulating layer the blurredness does not occur and images having sharp edges are produced. Preventing the light from reaching the insulating layer does not otherwise adversely affect the process, and the quality of multiple copies does not significantly deteriorate.

BRIEF DESCRIPTION OF DRAWINGS

FIGS. 3, 4, and 5 are further explained in the examples which follow.

BEST MODE FOR CARRYING OUT THE INVENTION

Figure 1:
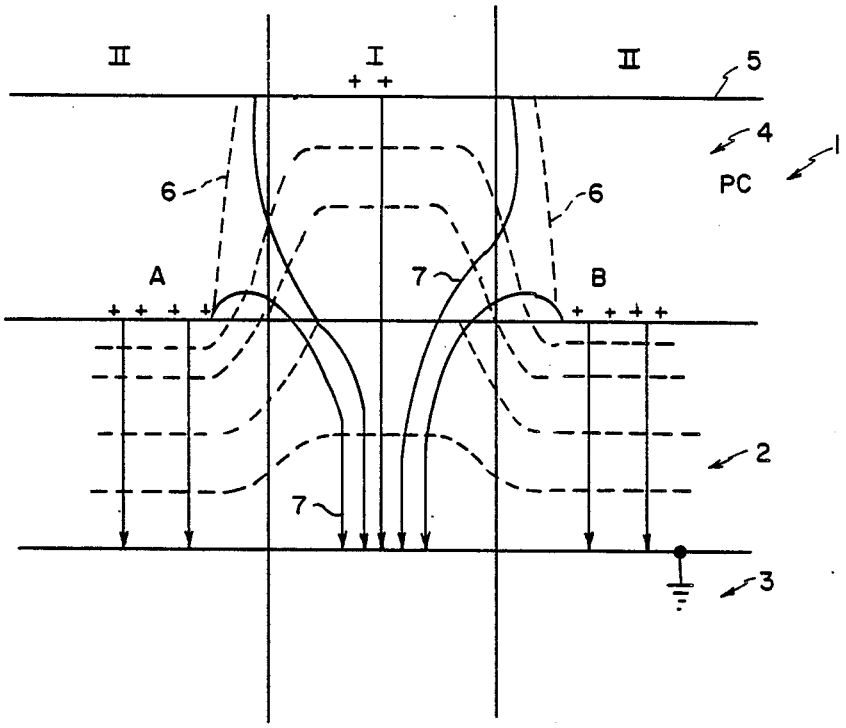
FIG. 1 is a diagrammatic side view showing a photoconductive buffer element according to this invention after simultaneous charging and imagewise exposing.

In FIG. 1 a photoconductive element 1 consists of insulating layer 2 sandwiched between conductor 3 and photoconductor 4.

FIG. 1 shows the state of the photoconductive element after simultaneous charging and imagewise exposing. The area designated I was not exposed to light and the area designated II were exposed to light during the imagewise exposure. Because the element was charged at the same time that it was imagewise exposed, the electric potential at surface 5 of the photoconductor is uniform. As shown in FIG. 1, the potential on surface 5 of photoconductor 4 will always be uniform at this stage, but the proportion of charge density on insulating layer 2 to charge density on surface 5 of photoconductor 4 will depend upon the thickness and dielectric constants of photoconductor 4 and insulating layer 2.

FIG. 1 also shows what are believed to be the equal potential lines 6 (the dashed lines) and the electric fields lines 7 (the solid lines, which are perpendicular to the lines of equal potential 6) in the element after the simultaneous charge and imagewise exposure. Upon uniform exposure to generate positive and negative charge pairs, positive charges follow electric field lines 7 downward and negative charges follow electric field lines 7 upward.

To prevent the disruption of charges on the surface of the photoconductor in unexposed area I, those charges are driven down to the surface of the insulating layer by uniform exposure to radiation. All of the charges are then on the surface of the insulating layer, but the electrostatic image is preserved because the charges driven down by the uniform exposure are fewer (per unit area) than the charges formed on the surface of the insulating layer when the element was charged during imagewise exposure. Because all the charges are now on the surface of the insulator they can be left undisturbed during developing and transfer. They can remain in position for hours or even days, and a latent electrostatic image can be stored, altered, and developed an hour or more after it is formed.

As shown in FIG. 1, light that strikes areas II during the uniform exposure does not disrupt the charges that are already formed on the insulating layer since the electric field is essentially zero across the photoconductor. However, light that generates a positive-negative charge pair in the area of curved electric field lines A or B is believed to be responsible for the lack of sharpness in the images. Charge pairs formed in these areas move apart with the positive charges following curved electric field lines A and B inward and downward. Similarly, the negative charges generated in the charge pairs follow curved electric field lines A and B laterally outward and downward where they annihilate positive image-forming charges. As a result, on insulating layer 2 the sharp delineation between unexposed areas I and exposed areas II is lost and the resulting copies become blurred at the edges of the images.

We have found that if the light used during the uniform exposure is not permitted to reach the insulating layer, sharp images are obtained. The less the light penetrates into the photoconductor during uniform exposure to light, the sharper is the image. Therefore, it is preferably that the light used during uniform radiation only penetrate less than half way through the photoconductive layer, and it is especially preferably if that light does not penetrate more than one-tenth through the photoconductive layer. This lack of penetration of the uniform light radiation can be achieved by selecting the photoconductor and the wavelength, brightness, and duration of the uniform light so that the uniform light is highly absorbed by the photoconductor. For example, if the photoconductor material strongly absorbs light having a wavelength of 680 nm, then red light having a wavelength of 680 nm would be used during the uniform exposure. Even though the light used during the uniform exposure penetrates the photoconductor only very slightly, we have found that it is nevertheless sufficient to drive the charges on the surface of the photoconductor down onto the surface of the insulating layer.

It will be understood that the materials selected for the photosensitive film buffer element are not critical so long as they permit the operation of the invention as described herein. Commonly used photoconductors include amorphous selenium, zinc oxide, anthracene, violanthrone, phthalocyanine, Crystal Violet, and polyvinylcarbazole. A multiple layer photoconductor can also be used in this invention. For example, a photoconductor may have a dye layer on the bottom and an outer protective layer on top. In this case, the protective layer on top should absorb the uniform radiation before it reaches the dye layer. The insulating layer may be selected, for example, from a variety of organic polymeric materials such as polycarbonates, polyesters, epoxies, and polysulfones. The conductive layer, which is usually mounted on a polymeric supporting layer, can be made of various metals such as nickel, copper, or aluminum.

Figure 2:
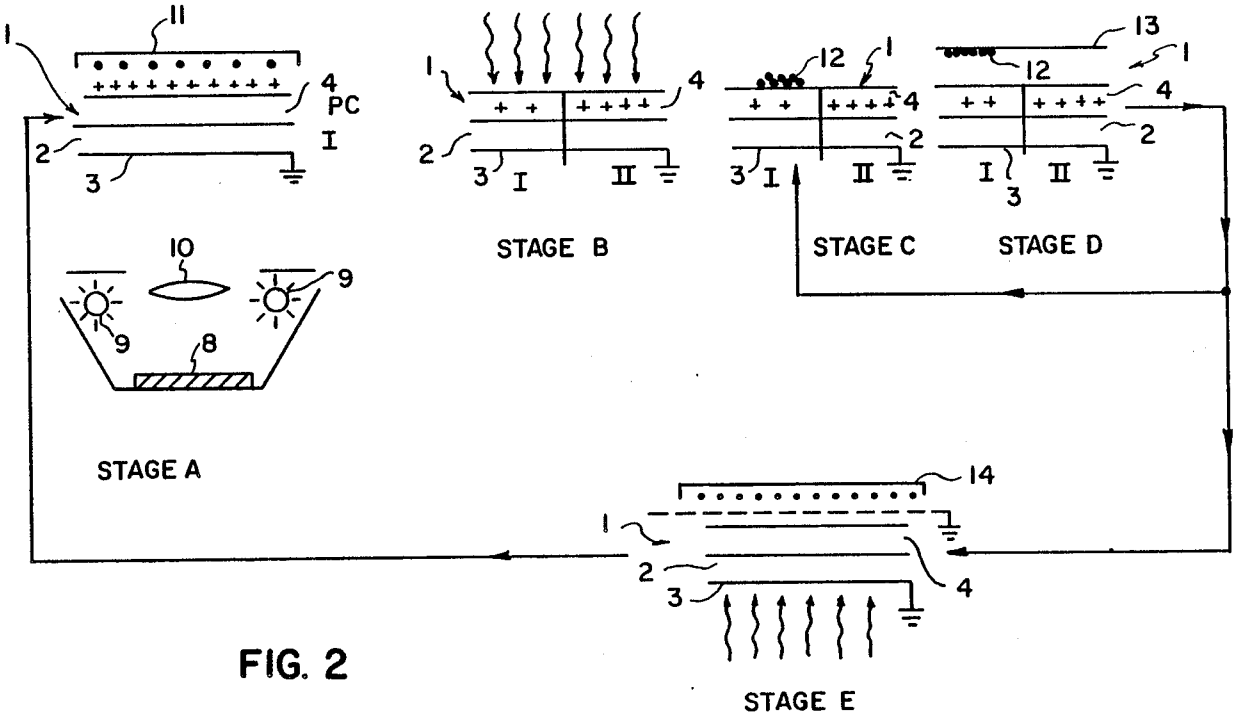
FIG. 2 is a diagrammatic side view illustrating an embodiment of the apparatus of this invention for making multiple copies.

In FIG. 2, at Stage A, as in FIG. 1, the photoconductive element 1 consists of insulating layer 2 sandwiched between grounded conductor 3 and photoconductor 4. Element 1 is simultaneously imagewise exposed and charged in the following manner. Original document 8 is illuminated by lamps 9 and its image is focused on element 1 by means of lens 10. (Alternatively, imaging can be accomplished using a laser or light emitting diodes with electronic input.) At the same time corona charger 11 places a charge on element 1. At Stage B element 1 is uniformly exposed to light from the top, which does not penetrate to insulating layer 2. The uniform light drives the charges on the surface of photoconductor 4 to the interface between insulating layer 2 and photoconductor 4. As in FIG. 1, area I was not imagewise exposed and contains fewer charges per unit area than does area II, which was imagewise exposed. At Stage C the latent electrostatic image in element 1 is developed by application of charged toner particles 12 to the top of element 1, particles 12 preferentially adhering to those areas of greatest potential difference between the photoconductor surface and the toning bias electrode. At Stage D the toned image is transferred to paper 13 or other receiver. Stages C and D can then be repeated to make multiple copies from the same imagewise exposure of element 1. When it is desired to erase the latent electrostatic image, one moves to Stage E. At Stage E element 1 is simultaneously subjected to a corona from grounded grid AC corona 14 and to uniform light exposure from the bottom. The apparatus is then ready to copy a new image at Stage A. Note that with the proper design the same apparatus can be used at all stages.

The simultaneous charging and imagewise exposing of the element is a procedure known to the art. It can, for example, be found in the Cannon NP copies described on page 11 et seq. of the book, "Electrophotography" by R. M. Schaffert. Briefly, the imagewise exposure can be made through a fine wire mesh corona charger, so that charging and imagewise exposing can be performed at the same time. It is also possible to use a transparent or semitransparent conductor and insulating layer, and make the imagewise exposure from the bottom through the conductor and insulator as shown in FIGS. 1 and 2. The uniform exposure, however, must be made from the top (i.e. directly into the photoconductive layer) to prevent the formation of charge pairs near the surface of the insulating layer. The photoconductor can be charged either positively or negatively in the practice of this invention and either negative or positively charged toners can be used to make either positive or negative appearing images.

Once the charges have been buried by the uniform exposure, multiple copies can be made in the conventional manner. The image is toned and is then transferred to a receiver, such as paper, where it can be fixed, for example, using heat and pressure. The surface of the photoconductor can be cleaned if desired. Additional copies are made in the same manner without recharging the photoconductor and without any further imagewise or uniform exposing of the photoconductor.

When it is desirable to erase the latent simultaneous electrostatic image, this can be accomplished by the application of a corona and light exposure to the photoconductive element. It is preferably to use a grounded grid AC corona for this purpose, and the use of light during the corona treatment aids in the erasure of the image. A DC corona of the opposite polarity can also be used to erase the image. After erasure, the element can be used again for making multiple copies by the same procedure.

The following examples further illustrate this invention.

EXAMPLE 1

A solution of 80 pbw (parts by weight) polycarbonate sold by General Electric under the trade designation "Lexan" in 720 pbw of a 3 to 1 weight mixture of dichloromethane and 1,1,2-trichloroethane was applied to a nickel-coated poly[ethylene terephthalate] film to form an insulating layer about 10 microns thick after evaporation of the solvent. This insulator-coated conductive support was then laminated with heat and pressure to an aggregate photoconductive layer of the type described in U.S. Pat. No. 3,615,396, herein incorporated by reference.

Figure 3:
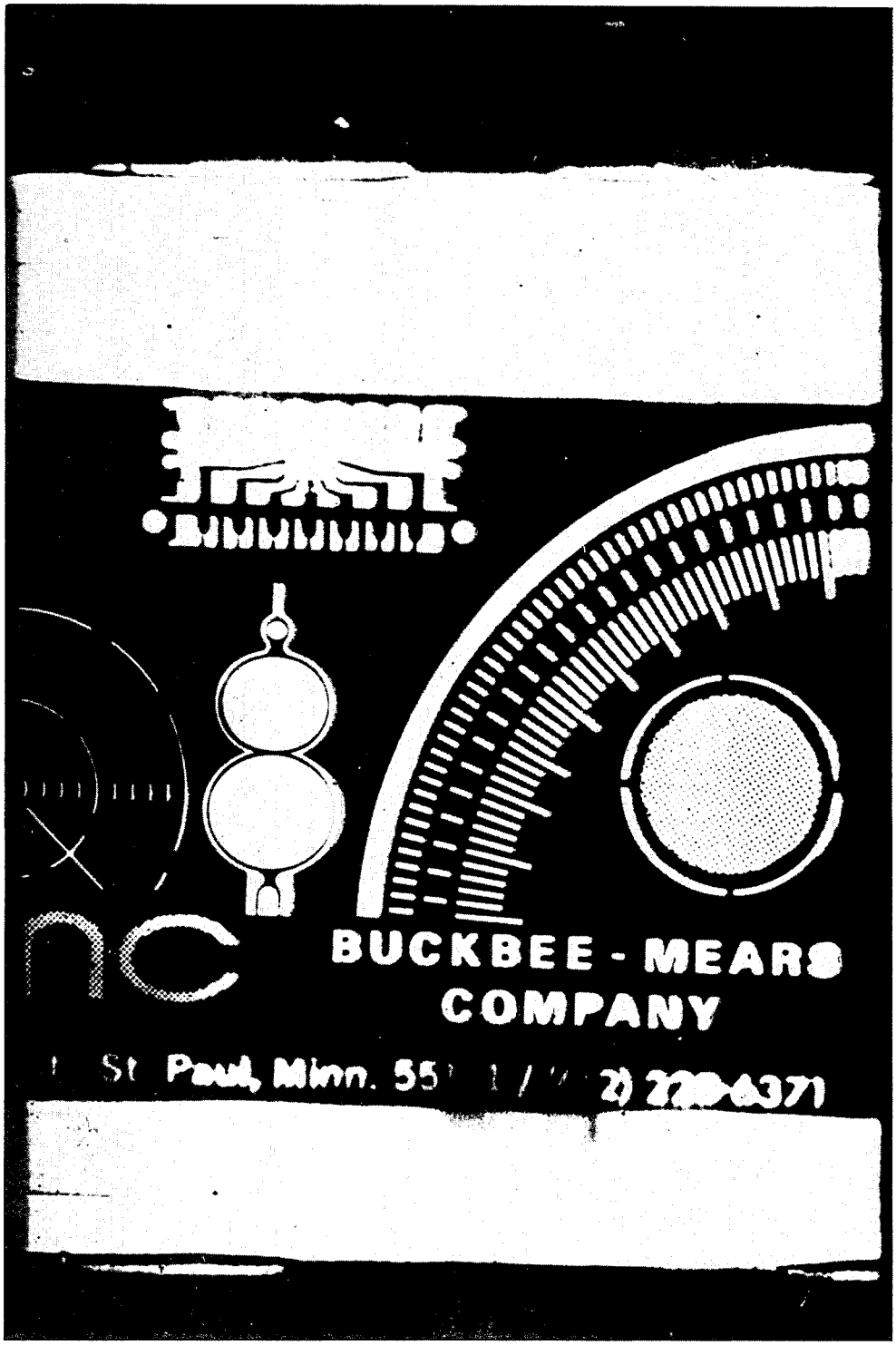
FIG. 3 is a photograph of a copy made using a photoconductive element that has an insulating layer in between a conducting layer and a photoconductive layer where the light used during uniform exposure did not reach the insulating layer.
Figure 4:
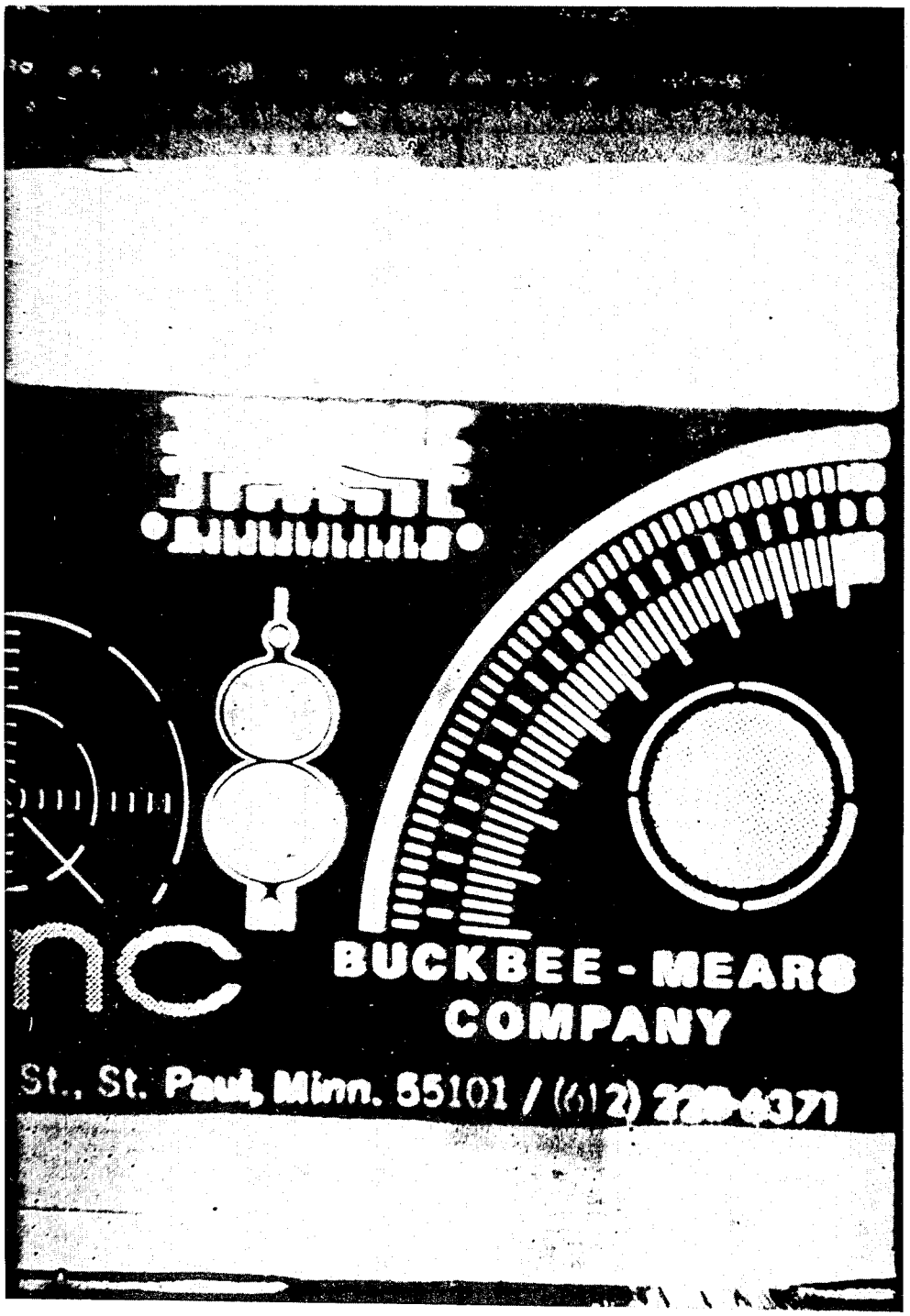
FIG. 4 is the fourth copy made from the same exposure used for the copy shown in FIG. 3.

The above photoconductive element was then simultaneously charged using an AC corona with DC bias and imagewise exposed through the conductive support layer until the surface potential was about +540 volts. Then a uniform exposure of light having a wavelength 680 nm, which is within the absorption peak of the photoconductor, was applied to the photoconductive surface of the element, reducing the surface potential in the unexposed areas to approximately +225 volts while not affecting the exposed areas, which remained at +540 volts. The resultant "buried" latent electrostatic image was then developed at 520 volts bias using a conventional developer containing 10% by weight of a ferrite carrier, 5.6% carbon colorant, 92.9% of a styrenebutylacrylate resin, and 1.5% charge agent. The developed image was then transferred to a paper receiver sheet using a grounded conductive roller. The resulting copy was of good quality and resolution and the edges of the image were sharp. FIG. 3 is a photograph of this copy. The above-described development and transfer steps were repeated without any further imagewise exposures to form a least four additional copies from the same photoreceptor. The quality of the additional copies did not deteriorate and the edges of the images remained sharp. The time delay between the first and the fourth copy, which is shown in FIG. 4, was about five minutes. FIG. 4 was less dense due to toner depletion, but it is as sharp as FIG. 3 and does not allow any increased blurredness at the edges of the images.

EXAMPLE 2

Figure 5:
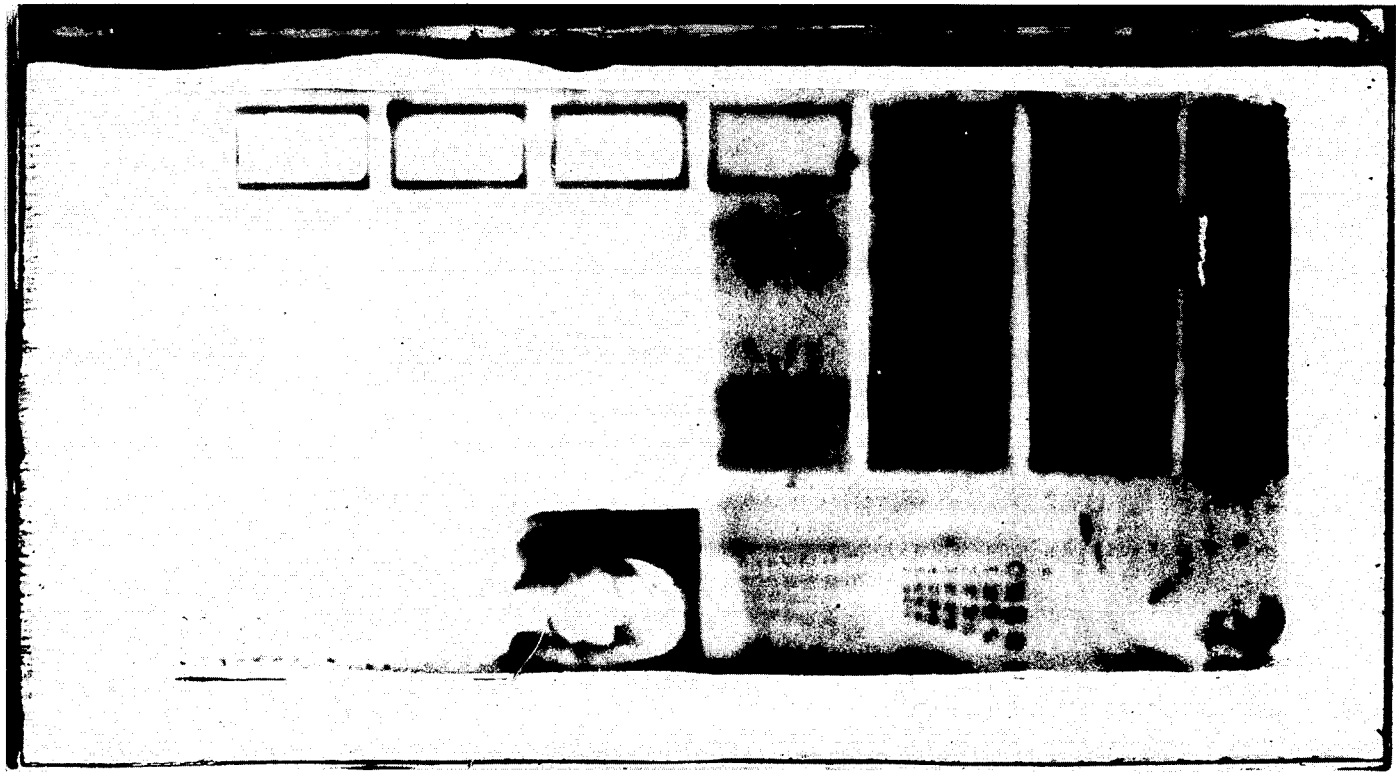
FIG. 5 is photograph of a copy made using the same photoconductive element used for FIG. 3 except that the light used during uniform exposure reached the insulating layer.

Example 1 was repeated except that the 680 nm uniform exposure was incident upon the transparent conductive support rather than on the photoconductor, which created charge carriers near the photoconductor-insulator interface. The resulting images were not sharp and became even more blurred at the edges of the images with subsequent copies. FIG. 5 is a photograph of one of these copies.

The invention has been described in detail with particular reference to preferred embodiments thereof, but it will be understood that variations and modifications can be effected within the spirit and scope of the invention.

We claim:

1. In a process for making multiple copies from a single imagewise exposure of an electrostatographic element having an insulating layer between a conductive layer and a photoconductive layer, where said element is simultaneously charged and imagewise exposed, then exposed with uniform light to drive the charges down from the surface of the electrostatographic element to the surface of the insulating layer, the improvement wherein said uniform light is absorbed by said photoconductive layer and does not penetrate through said photoconductive layer to said insulating layer.

2. A method according to claim 1 wherein said uniform light penetrates less than half way through said photoconductive layer.

3. A method according to claim 2 wherein said uniform light penetrates less than one-tenth through said photoconductive layer.

4. A method according to claim 1 wherein the wavelength of said uniform light falls within an absorption peak of said photoconductive layer.

5. A method according to claim 1 wherein said photoconductive layer comprises a layer containing a photoconductive dye under a transparent protective layer, and said uniform light is absorbed by said transparent protective layer and does not penetrate to said dye.

6. A method of making multiple electrostatographic copies comprising (A) simultaneously charging and imagewise exposing an electrostatographic element which comprises, in order,
  (1) a conductive layer;
  (2) an insulating layer; and
  (3) a photoconductive layer;

(B) uniformly exposing said element with uniform light applied directly to the surface of said photoconductive layer such that said uniform light is absorbed by said photoconductive layer and does not penetrate through said photoconductive layer to said insulating layer, thereby forming a latent electrostatic image on said insulating layer;

(C) developing said latent electrostatic image and transferring said developed image to a receiver; and (D) repeating step (C) without additional imagewise exposures of said element.

7. A method according to claim 6 including the additional last step of erasing said latent electrostatic image on said insulating layer by simultaneously charging and uniformly exposing said element to light.

8. A method according to claim 6 wherein said latent electrostatic image is developed at least one hour after it is formed.

* * * * *